US006983610B1

(12) United States Patent
Olson

(10) Patent No.: US 6,983,610 B1
(45) Date of Patent: Jan. 10, 2006

(54) COLD INERTANCE TUBE FOR MULTI-STAGE PULSE TUBE CRYOCOOLER

(75) Inventor: Jeffrey R. Olson, San Mateo, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/049,675

(22) Filed: Feb. 4, 2005

Related U.S. Application Data

(63) Continuation of application No. 10/388,187, filed on Mar. 12, 2003, now Pat. No. 6,865,894.

(60) Provisional application No. 60/367,782, filed on Mar. 28, 2002.

(51) Int. Cl.
*F25B 9/00* (2006.01)
*F25B 9/10* (2006.01)

(52) U.S. Cl. ..... 62/6; 62/335; 62/513

(58) Field of Classification Search ..... 62/6, 62/513, 79, 238.2, 335
See application file for complete search history.

(56) References Cited

U.S. PATENT DOCUMENTS

| | | | | |
|---|---|---|---|---|
| 4,953,366 | A | 9/1990 | Swift et al. | |
| 5,181,383 | A * | 1/1993 | Goto et al. | 62/6 |
| 5,295,355 | A | 3/1994 | Zhou et al. | |
| 5,335,505 | A * | 8/1994 | Ohtani et al. | 62/6 |
| 5,412,952 | A * | 5/1995 | Ohtani et al. | 62/6 |
| 5,845,498 | A | 12/1998 | Matsui et al. | |
| 5,953,920 | A | 9/1999 | Swift et al. | |
| 5,966,943 | A | 10/1999 | Mitchell | |
| 6,021,643 | A | 2/2000 | Swift et al. | |
| 6,032,464 | A | 3/2000 | Swift et al. | |
| 6,109,041 | A | 8/2000 | Mitchell et al. | |
| 6,256,998 | B1 | 7/2001 | Gao | |
| 6,442,947 | B1 | 9/2002 | Mitchell | |
| 6,865,894 | B1 * | 3/2005 | Olson | 62/6 |

FOREIGN PATENT DOCUMENTS

JP 09178279 A * 7/1997

OTHER PUBLICATIONS

Gardner et al., *Use of Inertance in Orifice Pulse Tube Refrigerators*, Cryogenics 1997, vol. 37, No. 2, Condensed Matter and Thermal Physics Group, MS K764 Los Alamos National Laboratory, Los Alamos, NM 87545 USA.

(Continued)

*Primary Examiner*—Cheryl Tyler
*Assistant Examiner*—Richard L. Leung
(74) *Attorney, Agent, or Firm*—McDermott Will & Emery LLP

(57) ABSTRACT

The performance of a multi-stage inertance pulse tube cryocooler in accordance with an embodiment of the present invention may be enhanced by cooling the inertance tube of one stage placing it in thermal communication with the cool heat exchanger of a preceding stage. Cooling at least one inertance tube of a multi-stage cooler in this invention lowers the viscosity and sound speed of the gas in the inertance tube, thereby improving the cooling power for that subsequent cooling stage, and for the entire device.

7 Claims, 4 Drawing Sheets

OTHER PUBLICATIONS

Gifford, E. *Excepts From Pulse Tube Refrigerator*, Semi-Annual Technical Report No. 2, Jul. 1963, Sponsored By Advanced Research Projects Agency, Syracuse University Research Institute, Mechanical Engineering Department.

Gifford, E., *Pulse-Tube Refrigeration*, Transactions of The ASME, Series B, Journal of Engineering For Industry, v. 86, Aug. 1964, pp. 264-268.

Ray, R., *Excerpts From Pulse Tube Refrigerators*, Cryogenic Technologies Group, Physical And Chemical Properties Division, National Institute Of Standards And Technology, Boulder, CO, Cryogenic Society of America, Short Course Symposium, Jul. 28, 1997, Portland, OR.

* cited by examiner

COLD INERTANCE TUBE FOR MULTI-STAGE PULSE TUBE CRYOCOOLER

CROSS-REFERENCES TO RELATED APPLICATIONS

This is a continuation application of application Ser. No. 10/388,187, filed Mar. 12, 2003, now U.S. Pat. No. 6,865,894, which in turn claims the benefit of U.S. Provisional Application No. 60/367,782, filed Mar. 28, 2002, which is incorporated by reference herein for all purposes.

BACKGROUND OF THE INVENTION

Cooling structures find use in a variety of applications. One class of cooling structures utilizes the compression, translation, and subsequent expansion of a gas to provide cooling effects.

FIGS. 1–1D show simplified cross-sectional views of a conventional Stirling cryocooler apparatus. FIG. 1 shows the basic Stirling cooler structure 1, wherein tube 2 contains a compressible gas 4 positioned between two moveable pistons 6 and 8. A first heat exchanger structure 10 is positioned in contact with the gas proximate to first piston 6. A second heat exchanger structure 12 is positioned in contact with the gas proximate to second piston 8. A thermal regenerator 14 in contact with the gas is positioned between the first and second heat exchangers 10 and 12.

Operation of the Stirling cooler shown in FIG. 1 is now described in connection with FIGS. 1A–1D. Generally, first piston 6 serves as a source of a pressure oscillation, and second piston 8 offers resistance to the pressure oscillation created by the first piston.

Specifically, in FIG. 1A, work is applied from an external source to move first piston 6. As shown in FIG. 1B, compressible gas 4 within tube 2 responds to movement of piston 6 first by being compressed, and then by being translated in the direction of the second piston 8. Some energy applied to the system at this time is absorbed and dissipated at first (hot) heat exchanger 10.

Translation of the gas compressed by the first piston is opposed by the mass of the second piston. As shown in FIG. 1C, because of the flow resistance posed by the second piston, translation of the gas ultimately halts and the gas expands. FIG. 1D shows that as a consequence of this gas expansion, the gas cools and second heat exchanger 12 in contact with the expanding gas absorbs thermal energy from the surrounding environment, imparting a cooling effect.

Regenerator 14 may comprise a porous solid matrix (such as parallel plates or holes, screens, felts or packed sphere beds) which intercepts heat from the gas, insulating the warm end from the cold end. As the gas flows from the warm end to the cold end, it deposits heat in the regenerator matrix, and as it flows back from cold to hot, it extracts the same amount of heat. Thus, the regenerator acts as a passive thermal insulation device.

The efficiency and effectiveness of the Stirling cooler is highly dependent upon the phase relationship between the velocity and pressure of gas within the tube. This is because the cooling mechanism requires that the gas be in the warm end during compression, and in the cold end during expansion.

The conventional Stirling cryocooler design shown and illustrated in connection with FIGS. 1–1D has been successful in providing cooling under a variety of conditions. However, the Stirling cryocooler design includes two separate moving parts: the first piston 6 and the second piston 8.

The complexity offered by these moving parts can offer a disadvantage in extraterrestrial applications such as satellites or space craft, where repair or replacement of worn moving parts is not possible.

Accordingly, efforts have been made to simplify the Stirling cryocooler design shown in FIGS. 1–1D. One such design is the orifice pulse tube cryocooler shown in simplified cross-sectional view in FIG. 2.

Like the Stirling cryocooler shown in FIGS. 1–1D, orifice pulse tube cryocooler 200 includes tube 202 enclosing compressible gas 204 in contact with a moveable piston 206 and first heat exchanger 208 proximate to the compressible gas. Also like the Stirling cryocooler shown in FIGS. 1–1D, orifice pulse tube cryocooler 200 of FIG. 2 includes thermal regenerator 214 in contact with the compressible gas at a point between first heat exchanger 208 and second heat exchanger 212 in contact with the compressible gas at a point distal from first heat exchanger 208.

Unlike the Stirling cryocooler structure shown in FIGS. 1–1D, however, the orifice pulse tube cryocooler 200 has no second moveable piston. Instead, this element has been replaced by pulse tube 220 in fluid communication with tube 202 at the location of the second heat exchanger 212. Pulse tube 220 is in turn in fluid communication with a gas reservoir 222 through an orifice 224. A third, pulse tube heat exchanger 226 is positioned in contact with the gas at the junction between pulse tube 220 and orifice 224.

Operation of the pulse tube orifice cryocooler of FIG. 2 is similar to that of the Stirling cryocooler of FIGS. 1–1D. Specifically, external work is initially applied to piston 206 from an external source. Compressible gas 204 within tube 202 responds to movement of piston 206 first by being compressed, and then by being translated in the direction of the pulse tube 220. Some energy applied to the system at this time is absorbed and dissipated at first (hot) heat exchanger 210.

Translation of the gas compressed by piston 206 is opposed by the constriction offered by orifice 224. Because of the flow resistance posed by the orifice 224, translation of the gas ultimately halts and the gas expands. As a consequence of this gas expansion, the gas cools and second (cold) heat exchanger 212 absorbs thermal energy from the surrounding environment, thereby imparting a cooling effect. Energy is dissipated in the orifice 224 and removed at the (third) pulse tube heat exchanger 226. The pulse tube 220 is an open tube filled with gas that transmits work from the cold end to the orifice, while thermally insulating the cold end from the warm end.

In sum, the cooling cycle of the orifice pulse tube cryocooler shown in FIG. 2 is the same as that of a Stirling cooler, but with the cold piston replaced by passive acoustic component having no moving parts. The pulse tube acts like gas piston, insulating the cold (second) heat exchanger from the warm (third) heat exchanger. The orifice dissipates power at the third, pulse tube heat exchanger, and this dissipated power represents the gross cooling power of the orifice pulse tube cooler.

If the volume of the reservoir is sufficiently large (that is, if it has a large enough compliance, a gas analogy to electrical capacitance), the velocity of gas at the warm end of the pulse tube and the pressure oscillations will be in phase, and the orifice will perform as a gas equivalent to a simple resistor of an analogous electrical system. If, however, the volume of the reservoir is small, the velocity of the gas will lead the pressure of the gas by some phase angle.

Optimum cooler performance usually has the gas pressure leading the velocity by about 45° at the second (cold) heat exchanger.

The orifice pulse tube design shown in FIG. 2 offers the advantage of fewer moving parts and reduced complexity over the Stirling cooler. However, the orifice pulse tube cryocooler of FIG. 2 does suffer from certain disadvantages relative to operation of the Stirling cryocooler. Specifically, the gas pressure and velocity are in-phase at the orifice, whereas the optimum condition has the pressure leading the velocity by about 45° at the second (cold) heat exchanger.

Therefore, there is a need in the art for improved cooling structures having simplified designs.

BRIEF SUMMARY OF THE INVENTION

In accordance with an embodiment of the present invention, performance of a multi-stage inertance pulse tube cryocooler may be enhanced by cooling the inertance tube of a later stage by placing it into thermal contact with the heat exchanger of a preceding stage. Cooling at least one inertance tube of a multi-stage cryocooler in accordance with an embodiment of the present invention lowers the viscosity and sound speed of gas in the inertance tube, thereby improving the cooling power for that cooling stage and for the entire device.

An embodiment of a cooling structure in accordance with the present invention comprises a moveable piston or heat engine in fluid communication with a compressible gas located within a tube. A first cooling stage is in fluid communication with the tube and including a cold heat exchanger in thermal communication with the tube. A second cooling stage is in fluid communication with the first cooling stage, the second cooling stage including an inertance tube in thermal communication with the cold heat exchanger of the first cooling stage through a thermal link.

An embodiment of a method in accordance with the present invention for improving the efficiency of a multi-stage inertance tube cooling structure, comprises placing a cold heat exchanger of a preceding stage in thermal communication with an inertance tube of a subsequent stage in order to reduce a viscosity of gas within the inertance tube.

A cooling method comprising creating at a first point an oscillation in pressure of a compressible gas disposed within a tube, and translating the compressed gas to a second point of the tube proximate to a heat exchanger. The translated gas is allowed to expand, and the heat exchanger is placed in thermal communication with an inertance tube of a subsequent cooling stage in fluid communication with the tube, thereby reducing a viscosity and sound speed of gas within the inertance tube.

A further understanding of embodiments in accordance with the present invention can be made by way of reference to the ensuing detailed description taken in conjunction with the accompanying drawings.

DETAILED DESCRIPTION OF THE INVENTION

Figure 1:
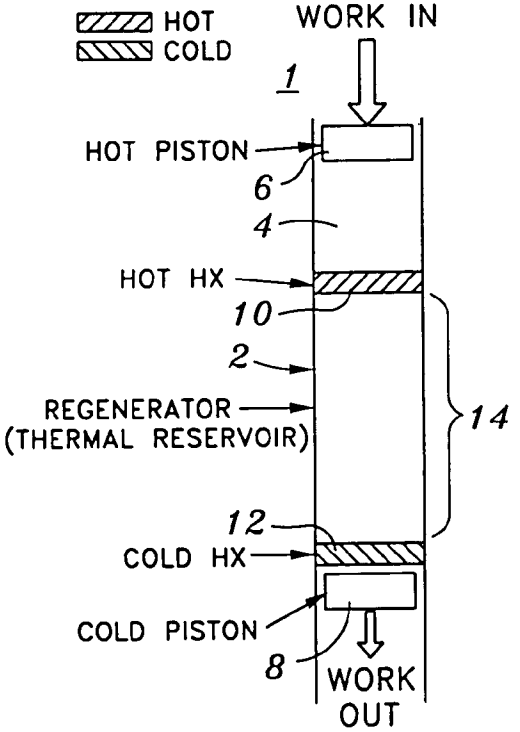
FIG. 1 (PRIOR ART)
FIG. 1 is a simplified cross-sectional view of a conventional Stirling-type cryocooler.
Figure 1A:
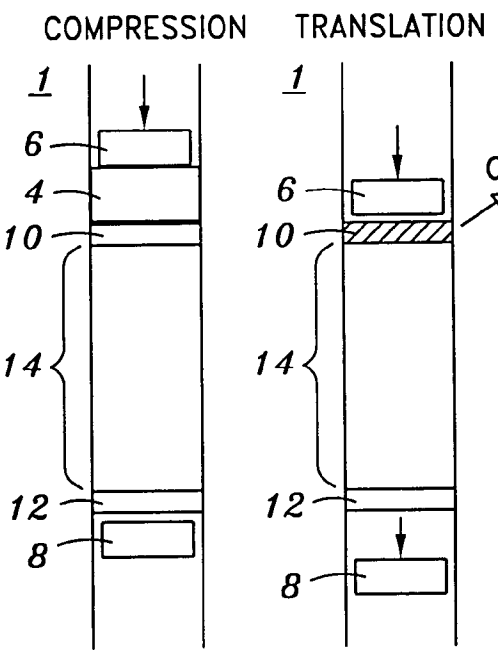
FIG. 1A (PRIOR ART)
FIGS. 1A–1D are simplified cross-sectional views illustrating operation of the Stirling-type cryocooler shown in FIG. 1.
Figure 1B:
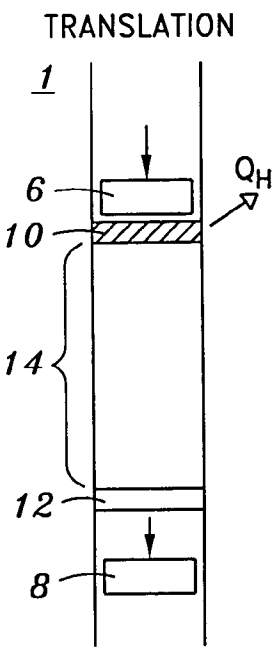
FIG. 1B (PRIOR ART)
Figure 1C:
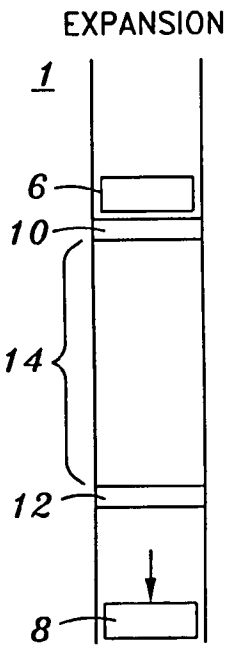
FIG. 1C (PRIOR ART)
Figure 1D:
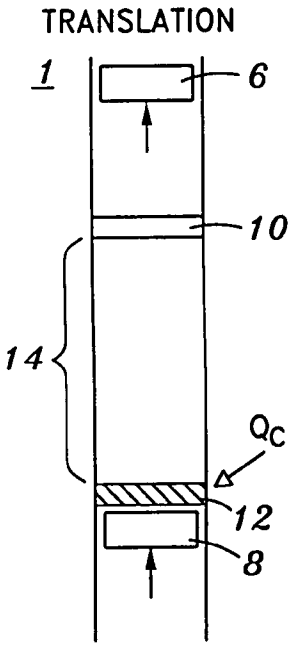
FIG. 1D (PRIOR ART)
Figure 3:
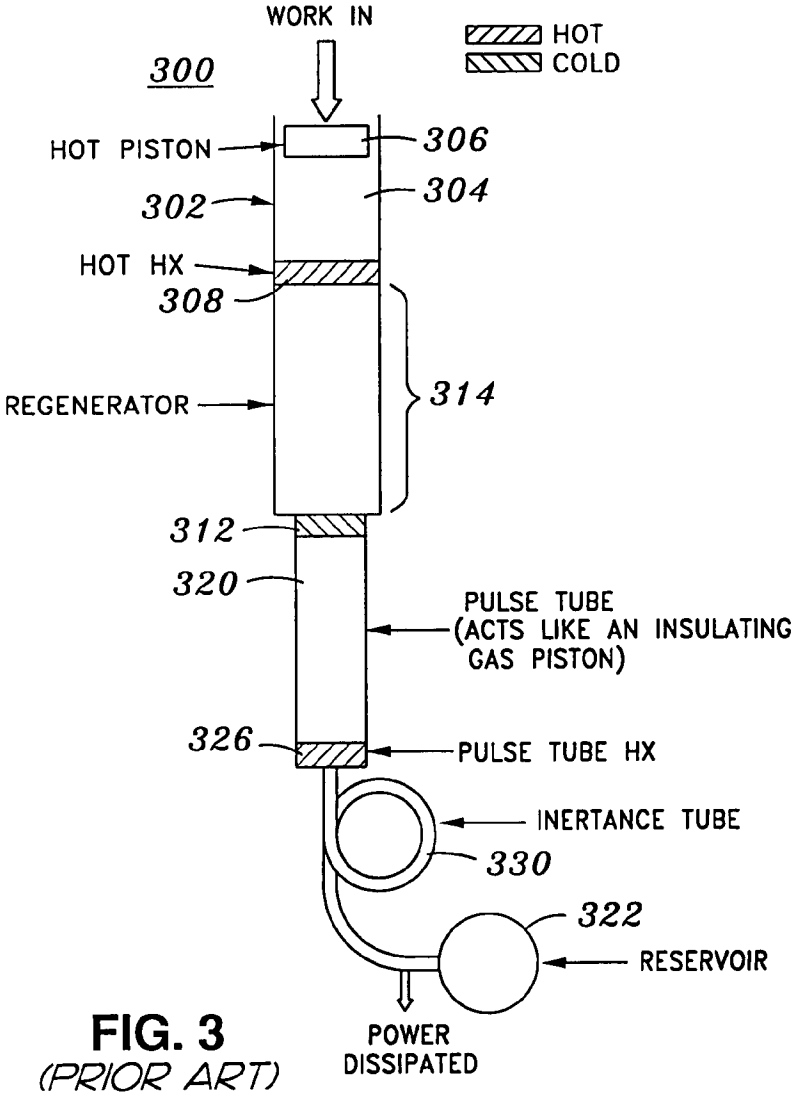
FIG. 3 (PRIOR ART)
FIG. 3 is a simplified cross-sectional view of a conventional inertance pulse tube cryocooler.

FIG. 3 shows a simplified cross-sectional view of a conventional inertance tube cryocooler structure. The inertance tube cryocooler structure 300 of FIG. 3 combines the desirable phase relationship between gas velocity and gas pressure exhibited by the Stirling cryocooler design of FIGS. 1–1D, with the reduced number of moving parts characteristic of the pulse tube cryocooler design of FIG. 2.

Figure 2:
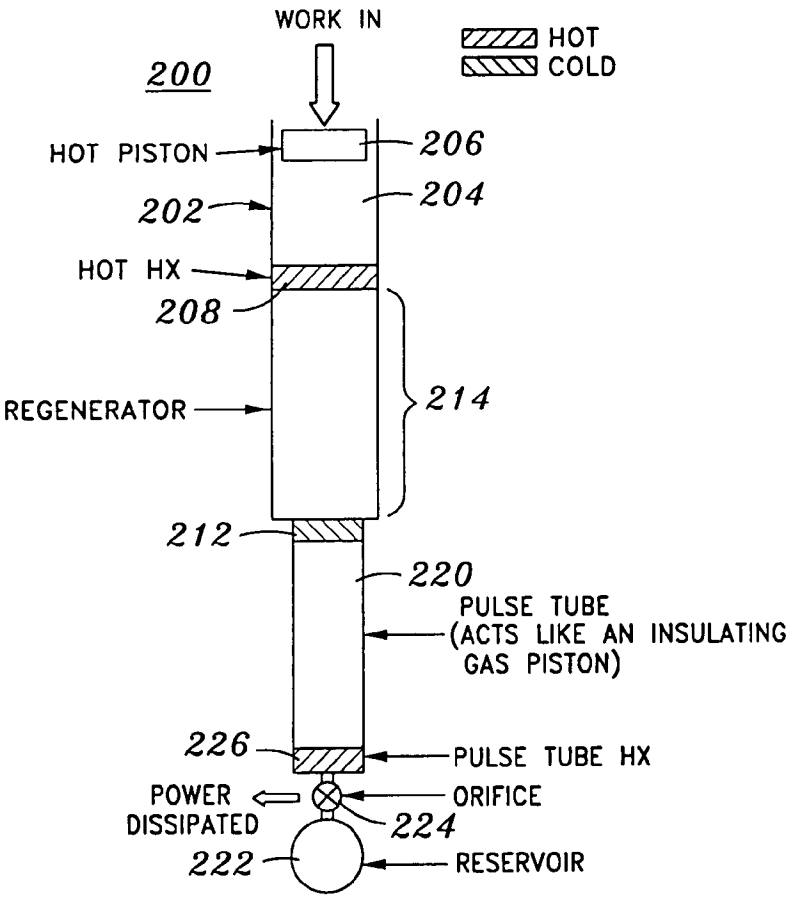
FIG. 2 (PRIOR ART)
FIG. 2 is a simplified cross-sectional view of a conventional orifice pulse tube cryocooler.

Specifically, like the pulse tube cryocooler shown in FIG. 2, inertance pulse tube cryocooler 300 of FIG. 3 includes tube 302 enclosing compressible gas 304 in contact with a moveable piston 306 and first heat exchanger 308 proximate to the compressible gas. Also like the pulse tube cryocooler shown in FIG. 2, the inertance tube cryocooler of FIG. 3 includes thermal regenerator 314 in contact with the compressible gas at a point between first heat exchanger 308 and second heat exchanger 312 that is in contact with the compressible gas at a point distal from first heat exchanger 308.

Unlike the pulse tube cryocooler shown in FIG. 2 however, the orifice has been replaced by an inertance tube 330 that is in fluid communication with the pulse tube 320 at a point distal from the second heat exchanger 312. The inertance tube 330 is also in fluid communication with gas reservoir 322, and pulse tube heat exchanger 326 remains positioned in contact with gas of pulse tube 320 proximate to the inlet to inertance tube 330.

Operation of the inertance pulse tube cryocooler of FIG. 3 is similar to that of the orifice pulse tube cryocooler of FIG. 2. Specifically, work from an external source is applied to move piston 306 into compressible gas 304. Compressible gas 304 within tube 302 responds to movement of piston 306 first by being compressed, and then by being translated in the direction of the pulse tube and inertance tube. Some energy applied to the system at this time is absorbed and dissipated at first (hot) heat exchanger 308.

Translation of the gas compressed by the piston is opposed by resistance offered as the gas flows through the narrow and elongated inertance tube. As a result of the flow resistance offered by the inertance tube, the translated gas ultimately halts and expands. As a consequence of this gas expansion, the gas cools and second heat exchanger 312 in contact with the expanding gas absorbs thermal energy from the surrounding environment thereby imparting a cooling effect.

The inertance tube 330 improves performance of the cooling structure by providing a phase shift between the pressure and the velocity of the translated gas. Specifically, inertance tube 330 functions as the gas equivalent of an inductor in series with a resistor in an analogous electrical system. The simple orifice configuration cannot provide the optimum phase reductions between pressure and velocity. The long thin capillary of the inertance tube 330 can shift the phase relationship between velocity and pressure of the moving gas at the cold heat exchanger to the optimum value of forty-five degrees.

Figure 4:
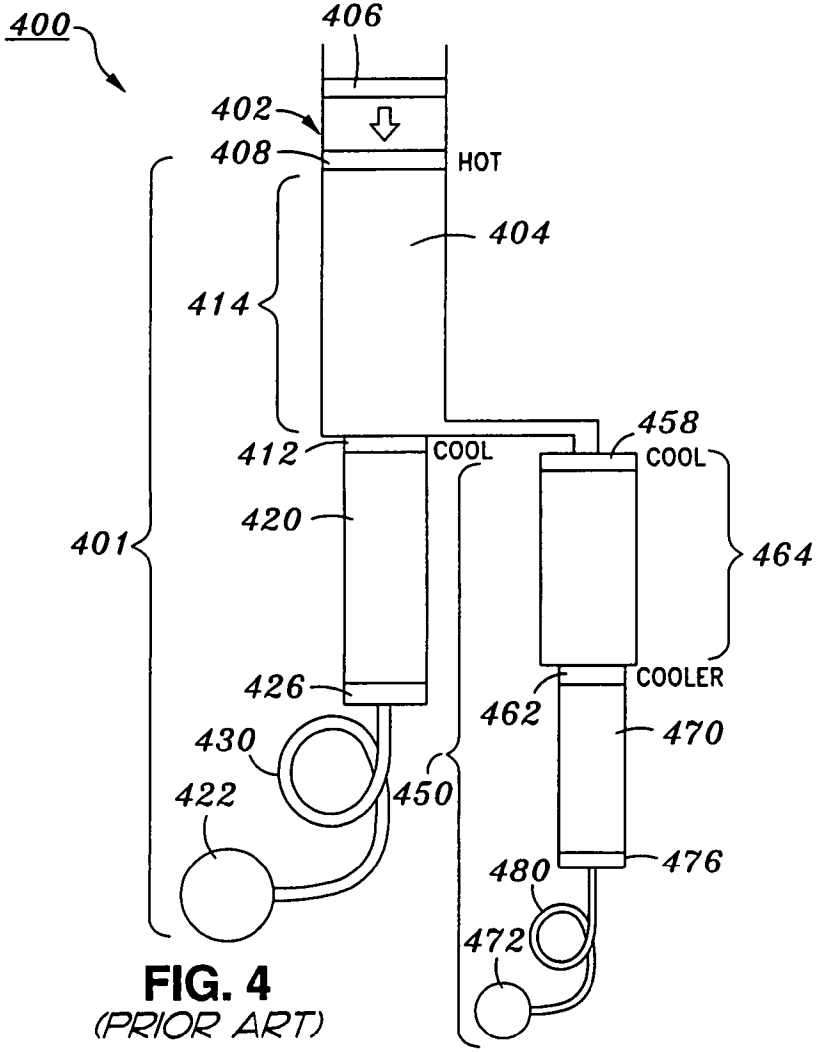
FIG. 4 (PRIOR ART)
FIG. 4 is a simplified cross-sectional view of a conventional multi-stage inertance pulse tube cryocooler.

Multiple inertance tube cryocoolers can be arranged in series to provide a cumulative cooling effect. FIG. 4 shows a simplified plan view of such a conventional multi-stage cooling structure. Cooler 400 comprises first stage 401 in series with second stage 450.

First stage 401 comprises first tube 402 containing compressible gas 404 and in fluid communication with a moveable piston 406. First heat exchanger 408 is positioned in contact with the compressible gas at a point proximate to the piston 406. Second heat exchanger 412 is positioned in contact with the compressible gas 404 at a point distal from the first heat exchanger 408. Regenerator 414 is positioned in contact with the compressible gas between first heat exchanger 408 and second heat exchanger 412.

Pulse tube 420 in fluid communication with inertance tube 430 and reservoir 422, is positioned in fluid contact with tube 402 at the second heat exchanger 412. A third heat exchanger 426 is positioned in contact with the compressible gas where the inertance tube connects with the pulse tube.

Cooling structure 400 also includes second stage 450. Second stage 450 comprises first heat exchanger 458 in fluid communication with compressible gas 404 at second heat exchanger 412 of first stage 401. Second heat exchanger 462 is positioned in contact with the compressible gas 404 at a point distal from the first heat exchanger 458. Regenerator 464 is positioned in contact with the compressible gas between first heat exchanger 458 and second heat exchanger 462.

Pulse tube 470 in fluid communication with inertance tube 480 and reservoir 472, is positioned in fluid contact with regenerator 464 at the second heat exchanger 462. A third heat exchanger 476 is positioned in contact with the compressible gas where the inertance tube connects with the pulse tube.

Operation of the conventional multi-stage cooling apparatus shown in FIG. 4 is cumulative. Specifically, compressed gas translated from the first stage may in turn compress gas located at first heat exchanger 458 of the second stage 450, in turn giving rise to translation and subsequent expansion of the gas of the second stage. As the translated gas has already been cooled by the first stage, further compression and cooling is possible by operation of the second stage.

Gardner and Swift, "Use of Inertance in Orifice Pulse Tube Refrigerators," CRYOGENICS, Vol. 37, No. 2, (1997) ("the Gardner and Swift paper") presents an insightful analysis of the performance of pulse tube cryocooler designs, including inertance tube cryocooler designs. The Gardner and Swift paper is hereby incorporated by reference for all purposes.

The Gardner and Swift paper makes a number of simplifying assumptions. First, the inertance tube is treated as a lumped element, with a single gas velocity and pressure throughout. In reality however, the length of the inertance tube is typically a quarter of the gas wavelength. The pressure amplitude thus goes from a maximum at the warm (first) heat exchanger, to zero at the reservoir volume. The gas velocity is smallest at the warm (first) heat exchanger and larger at the reservoir end of the inertance tube.

A second assumption of the Gardner and Swift paper is to ignore thermal dissipation at the tube wall. In reality however, gas undergoing oscillations in pressure also experiences a corresponding oscillation in temperature, and the temperature relaxation of gas near the tube walls causes dissipation.

A third assumption of the Gardner and Swift paper is a simplistic treatment of gas turbulence. This implications of this third assumption are complex, but ultimately it serves to underestimate the cooling power of an given inertance tube cooler design.

The Gardner and Swift paper concludes that for large-size coolers exhibiting a gross cooling power of about 50 W or greater, a single inertance tube can provide the proper inertance and dissipation. For smaller coolers, however, it becomes more difficult for the inertance tube to provide the desired phase shift while simultaneously providing sufficient inertance for a given dissipation.

In accordance with embodiments of the present invention, performance of a multi-stage inertance pulse tube cryocooler may be enhanced by cooling the inertance tube of a latter stage placing it into contact with the second (cold) heat exchanger of a preceding stage. Cooling at least one inertance tube of a multi-stage cooler in accordance with the present invention lowers the viscosity and sound speed of the gas in the inertance tube, thereby improving the cooling power for that subsequent cooling stage, and for the entire device.

The Gardner and Swift article just described summarizes performance of inertance pulse tube coolers in Equation (I) below:

$$\dot{E} \gtrsim \frac{\pi p_m a \delta_v^2}{4\gamma}\left|\frac{p_{E.1}}{p_m}\right|^2, \text{ where} \tag{I}$$

$\dot{E}$ = power dissipated;
$p_m$ = mean gas pressure;
$a$ = sound speed;
$\delta_v$ = viscous penetration depth;
$p_{E.1}$ = pressure amplitude; and
$\gamma$ = ratio of isobaric to isochoric specific heats Equation (II) below sets forth a relationship between viscous penetration depth and viscosity:

$$\delta_v^2 = \frac{2\mu a^2}{\omega\gamma p_m}, \text{ where} \tag{II}$$

$\delta_v$ = viscous penetration depth;
$\mu$ = gas viscosity;
$a$ = sound speed;
$\omega$ = angular frequency of the gas oscillations;
$\gamma$ = ratio of isobaric to isochoric specific heats; and
$p_m$ = mean gas pressure;

Substituting Equation (II) into Equation (I) yields Equation (III):

$$\dot{E} \geq \frac{\pi a^3 \mu}{2\gamma^2 \omega}\left|\frac{p_{E.1}}{p_m}\right|^2 \tag{III}$$

Equation (III) shows that the minimum gross cooling power ($\dot{E}$) for an inertance tube scales with the viscosity ($\mu$) and the cube of sound speed (a) of the gas. Embodiments of the present invention accordingly improve cooling performance by lowering the viscosity and sound speed by lowering the temperature of the gas within the inertance tube, reducing the minimum gross cooling power requirement.

Figure 5:
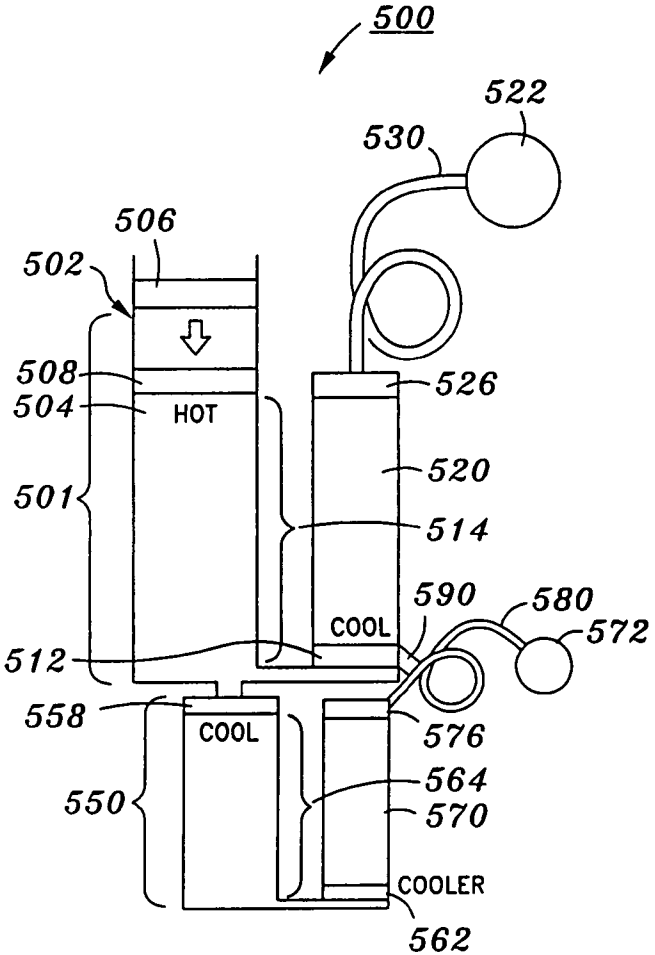
FIG. 5 is a simplified cross-sectional view of a multi-stage cold inertance pulse tube cryocooler in accordance with an embodiment of the present invention.

FIG. 5 shows a simplified cross-sectional view of an embodiment of a cryocooler structure in accordance with the present invention. Specifically, cryocooler 500 comprises first stage 501 in series with second stage 550.

First stage 501 comprises first tube 502 containing compressible gas 504 and in fluid communication with a moveable piston 506. First heat exchanger 508 is positioned in contact with the compressible gas at a point proximate to the piston 506. Second heat exchanger 512 is positioned in contact with the compressible gas 504 at a point distal from the first heat exchanger 508. Regenerator 514 is positioned in contact with the compressible gas between first heat exchanger 508 and second heat exchanger 512.

Pulse tube 520 in fluid communication with inertance tube 530 and reservoir 522, is positioned in fluid contact with tube 502 at the second heat exchanger 512. A third heat exchanger 526 is positioned in contact with the compressible gas where the inertance tube connects with the pulse tube.

Cooling structure 500 also includes second stage 550. Second stage 550 comprises first heat exchanger 558 in fluid communication with compressible gas 504 at second heat exchanger 512 of first stage 501. Second heat exchanger 562 is positioned in contact with the compressible gas 504 at a point distal from the first heat exchanger 558. Regenerator 564 is positioned in contact with the compressible gas between first heat exchanger 558 and second heat exchanger 562.

Pulse tube 570 in fluid communication with inertance tube 580 and reservoir 572, is positioned in contact with regenerator 564 at the second heat exchanger 562. A third heat exchanger 576 is positioned in contact with the compressible gas where the inertance tube 580 connects with the pulse tube 570.

Operation of the conventional multi-stage cooling apparatus shown in FIG. 4 is cumulative. Specifically, compressed gas translated from the first stage may in turn compress gas located at first heat exchanger 558 of the second stage 550, in turn giving rise to translation and subsequent expansion of the gas of the second stage. As the translated gas has already been cooled at by the first stage, further compression and further cooling is possible by operation of the second stage.

The cryocooler embodiment of FIG. 5 differs from the conventional multi-stage structure shown in FIG. 4 in that inertance tube 580 of second stage 550 is in thermal communication with the second (cold) heat exchanger 512 of the first stage 501 through thermal link 590.

As a result of the presence of thermal link 590, the temperature of the compressible gas within the inertance tube is lowered, which in turn reduces its viscosity and improves the phase relationship between gas velocity and pressure.

The use of a cooled inertance tube cryocooler design in accordance with an embodiment of the present invention offers a number of advantages over conventional designs. For example, the cooled inertance tube of the subsequent stage may have a smaller pulse tube, thus requiring less gas to be moved through the regenerator. Moreover, as mentioned above, the inertance tube of the second stage will function more effectively because of the lowered temperature and viscosity of the gas present therein.

Cooling the inertance tube in accordance with an embodiment of the present invention increases the heat load on the warmer stages, because the energy dissipated in the tube is an extra heat load to the intermediate stage. However, cooling the inertance tube greatly enhances its performance. For example, the following TABLE lists the temperature at different points of a conventional two-stage cooler and a two-stage cooler having a cold inertance tube in accordance with an embodiment of the present invention.

TABLE

| LOCATION OF CRYOCOOLER STRUCTURE | CONVENTIONAL TWO-STAGE CRYOCOOLER (FIG. 4) | TWO-STAGE CRYOCOOLER WITH COOLED SECOND INERTANCE TUBE (FIG. 5) |
|---|---|---|
| first (hot) heat exchanger of first stage | 300° K | 300° K |
| second (cold) heat exchanger of first stage | 100° K | 100° K |
| pulse tube heat exchanger of first stage | 300° K | 300° K |
| first (hot) heat exchanger of second stage | 100° K | 100° K |
| second (cold) heat exchanger of second stage | 35° K | 35° K |
| pulse tube heat exchanger of second stage | 300° K | 100° K |

The multi-stage inertance tube cryocoolers compared in the above TABLE exhibited the same cool temperature (35° K.) at the second heat exchanger of the second stage. However, the cryocooler structure in accordance with an embodiment of the present invention required 6% less input power to accomplish this result.

The foregoing description discloses only specific embodiments in accordance with the present invention, and modifications of the above disclosed apparatuses and methods falling within the scope of the invention will be apparent to those of ordinary skill in the art. Thus while the invention has been described so far in connection with the cooling of the second stage inertance tube of a two stage cryocooler, the invention is not limited either to a cryocooler having this number of stages, to this number of cooled inertance tubes, or to this particular thermal linkage of inertance tubes with cold heat exchangers of prior stages.

Figure 6:
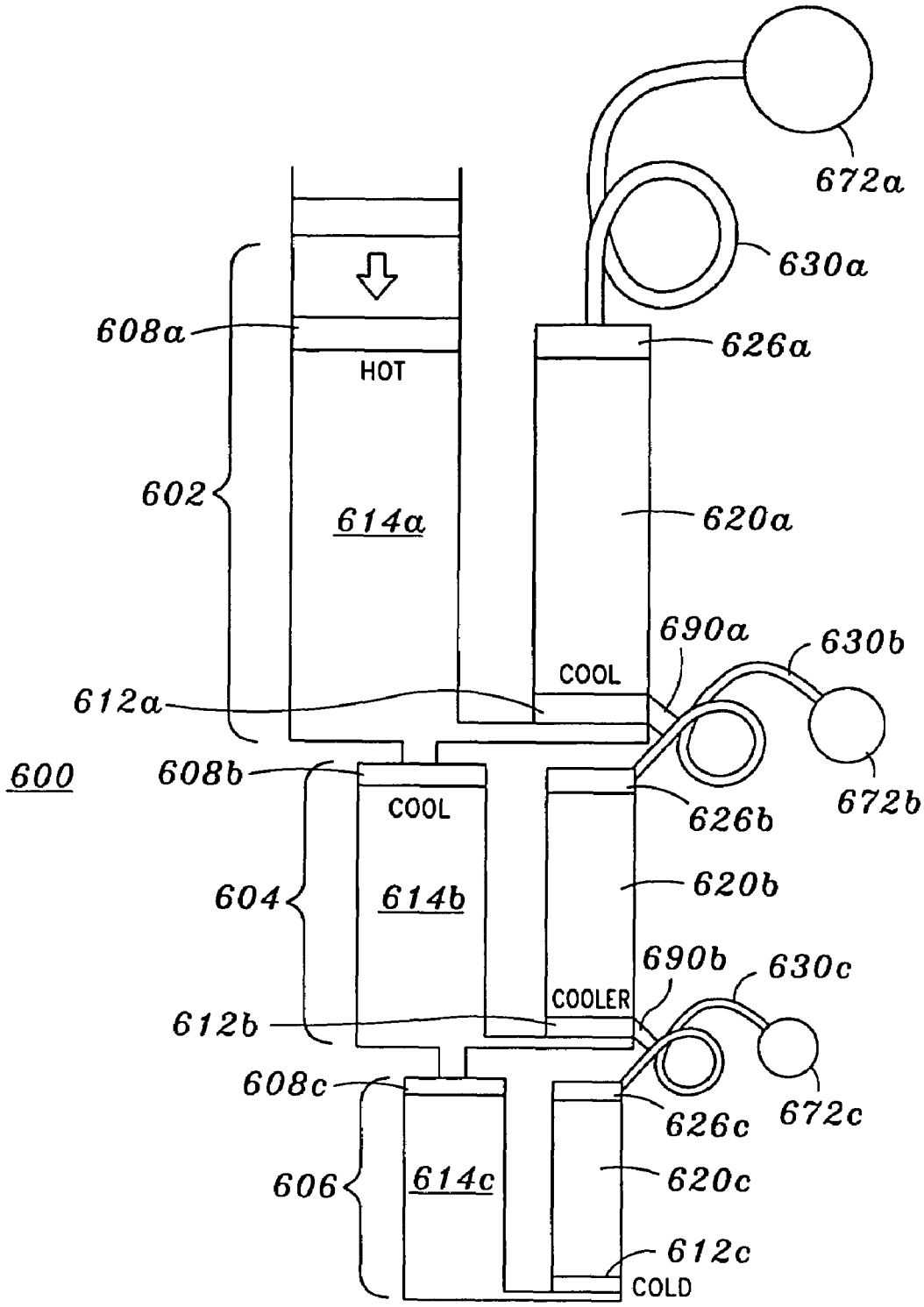
FIG. 6 shows a simplified cross-sectional view of an alternative embodiment of a multi-stage inertance tube cryocooler structure in accordance with the present invention.

For example, FIG. 6 shows a simplified cross-sectional view of an alternative embodiment of a multi-stage inertance tube cryocooler structure in accordance with the present invention. Cryocooler 600 of FIG. 6 comprises three stages 602, 604, and 606 arranged in series, with each stage including a respective first heat exchanger 608, regenerator 614, second heat exchanger 612, pulse tube 620, pulse tube heat exchanger 626, inertance tube 630, and reservoir 672. Inertance tube 630*b* of second stage 604 is in thermal communication with second heat exchanger 612*a* of first stage 602 through first thermal link 690*a*. Inertance tube 630*c* of third stage 606 is in thermal communication with second heat exchanger 612*b* of second stage 604 through second thermal link 690*b*. Efficiency in operation of the coldest stage of the series shown in FIG. 6 will benefit from this approach.

Again, while FIG. 6 shows cooling of the inertance tube of a subsequent stage in a three-stage cooler, this is only one specific example and the present invention is not limited to a cryocooler having this or any particular number of stages. An inertance tube cooled by a heat exchanger of a prior stage of a cooler having four, five, six, or any number of stages, would also fall within the scope of the present invention.

And while the embodiment illustrated in FIG. 6 shows the inertance tube of the second and third stages as being in thermal communication with the cold heat exchanger of the immediately preceding stage, this is not required by the present invention. In accordance with other additional alternative embodiments, the inertance tube of a subsequent stage could be in thermal communication with the cold heat exchanger of other than an immediately preceding stage. For example the inertance tube of the third stage of the cooler structure shown in FIG. 6 could be in thermal communication with the cold heat exchanger of the first stage, rather than the cold heat exchanger of the second stage.

Moreover, while the embodiment illustrated in FIG. 6 shows the gas proximate to the first heat exchanger of the first stage as being in fluid communication with a moveable piston, this is not required by the present invention. In accordance with alternative embodiments of the present invention, gas within the tube could be in fluid communication with a source of pressure oscillation other than a moveable piston. An example of such an alternative source of pressure oscillation is a heat engine. One particular type of heat engine is described in detail by G. W. Swift in "Thermoacoustic Engines", J. Acous. Soc. of America, Vol. 84, pp. 1145–1180 (1988).

The scope of the invention should, therefore, be determined not with reference to the above description, but instead should be determined with reference to the appended claims along with their full scope of equivalents.

What is claimed is:

1. A multi-stage cryocooler comprising:

a first cooling stage in fluid communication with a tube supplied with compressible gas from a source of pressure oscillation, the first cooling stage including a cold heat exchanger which is in thermal communication with the tube;

a second cooling stage in fluid communication with the first cooling stage, said second cooling stage including an inertance tube in thermal communication with the cold heat exchanger of the cold heat exchanger of the first cooling stage through a thermal link;

a third cooling stage including a second inertance tube in thermal communication with a cold heat exchanger of the second cooling stage through a second thermal link; and a fourth cooling stage including a third inertance tube in thermal communication with a cold heat exchanger of the third cooling stage through a third thermal link.

2. The cooling structure of claim 1, wherein the first cooling stage further comprises:

a hot heat exchanger in thermal communication with the tube at a location proximate to the source of pressure oscillation;

the cold heat exchanger in thermal communication with the tube at a location distal from the source or pressure oscillation; and a gas reservoir in fluid communication with the tube through a fourth inertance tube.

3. The cooling structure of claim 1, wherein the second cooling stage comprises:

a hot heat exchanger in thermal communication with the tube at a location proximate to the cold heat exchanger of the first stage; and a gas reservoir in fluid communication with the tube through the inertance tube, wherein the second cold heat exchanger is in thermal communication with the tube at a location distal from the hot heat exchanger.

4. The cooling structure of claim 1, wherein the third cooling stage comprises:

a hot heat exchanger in thermal communication with the tube at a location proximate to the cold heat exchanger of the second stage; and a gas reservoir in fluid communication with the tube through the second inertance tube, wherein the third cold heat exchanger is in thermal communication with the tube at a location distal from the hot heat exchanger.

5. The cooling structure of claim 1, wherein the fourth cooling stage comprises:

a hot heat exchanger in thermal communication with the tube at a location proximate to the cold heat exchanger of the third stage; and a gas reservoir in fluid communication with the tube through the third inertance tube, wherein the fourth cold heat exchanger is in thermal communication with the tube at a location distal from the hot heat exchanger.

6. A multi-stage cryocooler comprising:

at least first and second cooling stages, in thermal communication with a tube having compressible gas located therein;

a cold heat exchanger located in the first stage and in fluid communication with the tube;

an inertance tube located in the second cooling stage, wherein the cold heat exchanger of the first stage is placed in thermal communication with the inertance tube of the second stage through a first thermal link; and at least a third and a fourth stage, wherein the third stage includes a second inertance tube in thermal communication with a cold heat exchanger of the second stage through a second thermal link, and the fourth cooling stage includes a third inertance tube in thermal communication with a cold heat exchanger of the third stage.

7. The multi-stage cryocooler of claim 6, wherein the inertance tube of a subsequent stage is in thermal communication with a cold heat exchanger of the immediately preceding stage.

* * * * *